United States Patent [19]

Shibue et al.

[11] Patent Number: 4,594,315

[45] Date of Patent: Jun. 10, 1986

[54] LIGHT-SENSITIVE SILVER HALIDE PHOTOGRAPHIC ELEMENT WITH ELECTRON BEAM CURED INTERLAYER

[75] Inventors: Toshiaki Shibue; Koichi Nagayasu, both of Hino, Japan

[73] Assignee: Konishiroku Photo Industry Co., Ltd., Tokyo, Japan

[21] Appl. No.: 647,977

[22] Filed: Sep. 6, 1984

[30] Foreign Application Priority Data

Sep. 21, 1983 [JP] Japan ..... 58-174980
Sep. 22, 1983 [JP] Japan ..... 58-175885

[51] Int. Cl.[4] ..... G03C 1/76

[52] U.S. Cl. ..... 430/531; 430/271; 430/296; 430/532; 430/533; 430/536; 430/538; 430/534; 430/942; 427/35; 427/44

[58] Field of Search ..... 430/296, 271, 538, 531, 430/536, 532, 533, 942, 534; 427/35, 44

[56] References Cited

U.S. PATENT DOCUMENTS 3,323,946 6/1967 Ravve et al. ..... 117/161
4,322,450 3/1982 Gray et al. ..... 427/44
4,364,971 12/1982 Sack et al. ..... 427/44
4,384,040 5/1983 Von Meer ..... 430/532

*Primary Examiner*—Jack P. Brammer
*Attorney, Agent, or Firm*—Frishauf, Holtz, Goodman & Woodward

[57] ABSTRACT

A light-sensitive silver halide photographic element having (a) a cured coated layer on at least one surface of a support material, said cured coated layer having been formed by curing a composition with electron beam radiation, said composition prior to curing comprising (i) a compound having two or more unsaturated double bonds in its molecule which is curable by electron beam irradiation, (ii) an inorganic white pigment and (iii) a coupling agent having two or more different reactive groups in its molecule, one of said reactive groups being chemically reactive with the inorganic white pigment to form a chemical bond therewith and said other reactive group being chemically reactive with said compound (i) to form a chemical bond therewith and (b) at least one layer of silver halide emulsion on said coated layer.

11 Claims, No Drawings

LIGHT-SENSITIVE SILVER HALIDE PHOTOGRAPHIC ELEMENT WITH ELECTRON BEAM CURED INTERLAYER

BACKGROUND OF THE INVENTION

This invention relates to a light-sensitive silver halide photographic material. More particularly, it pertains to a light-sensitive silver halide photographic material, having a support prepared by electron beam irradiation, which is particularly suitable for photographic printing paper.

As the support for photographic printing paper, for the purpose of rapid photographic processing, use has recently been made of a paper material coated on its surface with a polyolefin resin.

And, for enhancement of the degree of whiteness or the shielding ability of the support, or resolution or sharpness after application of photographic emulsion, an inorganic white pigment such as titanium oxide, calcium carbonate, etc. is incorporated in the polyolefin resin.

Whereas, for formation of a coating of a polyolefin resin, the resin is required to be molten at a high temperature of about 280° to 340° C. And, in a polyolefin resin molten at such a high temperature, it is not possible to incorporate a large amount of an inorganic white pigment and its dispersibility is also poor. For this reason, there is involved the problem that no satisfactory sharpness of the photographic image can be obtained.

In view of the state of the art as mentioned above, a large amount of an inorganic pigment has been attempted to be added in a polyolefin resin by use of a dispersant.

For example, there have been proposed a technique for surface treatment of titanium oxide with a hydrous alumina as disclosed in Japanese Unexamined Patent Publication No. 6531/1976, a technique for surface treatment of titanium oxide with hydrous $Al(OH)_2$ or hydrous $Al(OH)_2$ and hydrous silicon dioxide as disclosed in Japanese Unexamined Patent Publication No. 35625/1977, a technique for coating treatment of titanium oxide with a surfactant as disclosed in Japanese Unexamined Patent Publication No. 108658/1980, a technique for coating treatment of the particle surface of titanium oxide with $\beta$-diketone chelate as disclosed in Japanese Unexamined Patent Publication No. 113039/1980, and a technique for coating treatment of particle surfaces of titanium oxide with amines as disclosed in Japanese Unexamined Patent Publication No. 113040/1980.

However, when employing these techniques, during high temperature melting of a polyolefin resin, contamination with the respective additives of an extruder at the die output end may be generated to form concave streaks on the molten film surface, which become the surface groove on the support, whereby coating irregularity of emulsion disadvantageouly occurs.

On the other hand, Japanese Unexamined Patent Publication No. 151942/1982 proposes to use an alkyl titanate in place of the above additives (which function as one kind of dispersants), and above drawbacks are improved.

However, in this case, the pigment treated with an alkyl titanate can be incorporated into the molten polyolefin resin only in an amount of about 10 to 20 wt. %, whereby no sufficient sharpness can be obtained. Also, free alkyl titanate which is not combined with the pigment is liable to be formed, and this may cause fuming during coating through pyrolysis on melting, or may be attached on the cooling roll to form a non-smooth film surface.

Thus, when incorporating a pigment in the polyolefin resin coating of the prior art, no sufficient sharpness can yet be obtained.

Under such a situation, Japanese Unexamined Patent Publications No. 27257/1982 and No. 49946/1982 propose a support for photography having a coated layer prepared by applying coating of a composition curable with electron beam irradiation on a paper substrate and allowing the coating to cure by irradiation of electron beam.

Such a support permits the content of an inorganic pigment to be increased to 20 to 70 wt.%, because coating is carried out at room temperature. Moreover, dispersing can be conducted very easily, with the result that sharpness can be improved by far greater as compared with the polyolefin resin coating.

However, a coating solution containing a resin curable with electron beam and a pigment involves the disadvantage that it is lower in storage stability and cannot be stored for a long time.

Also, after coating, the coating before irradiation of electron beam tends to be agglomerated and give poor filling chracteristic after curing, whereby the surface smoothness of the coated layer will become very bad.

Further, particularly when the amount of the pigment added is increased, the cured layer will become brittle to readily cause generation of stress cracks or stress crazes or lower adhesiveness with paper substrates.

Thus, in the electron beam cured coated layer according to the proposal, no consideration has been paid with respect to affinity or dispersibility between the resin curable with electron beam and the pigment, and also no consideration has been made about the mechanical properties of the coated layer when a large amount of the pigment was added, with the result that no practically satisfactory product can be obtained.

Now, one may consider improvement of dispersibility of the pigment by addition of various kinds of dispersibility enhancers together with the resin curable with electron beam and the pigment.

However, with the use of a conventional dispersibility enhancer such as surfactants, there is neither improved effect of adhesiveness when the amount of the pigment added is increased, nor the effect of embrittlement prevention of the coated layer after curing.

Further, with the use of a conventional dispersibility enhancer, by increase of its amount added, there is also a disadvantage that the coated layer becomes sticky.

SUMMARY OF THE INVENTION

An object of the present invention is to realize a light-sensitive silver halide photographic element using a support having a coated layer formed thereon by providing a layer of a composition containing a compound curable with electron beam and an inorganic white pigment and curing the layer with an electron beam, which has improved in dispersion of the pigment, can give excellent sharpness of the photographic image, also is improved in the filling characteristic of the pigment, excellent in smoothness of the support surface, further excellent in adhesion between the support material and the coated layer, being without embrittlement of the cured coated layer and free from occurrence of stress cracks or stress crazes.

Such an object can be accomplished by the present invention as described below.

This invention provides a light-sensitive silver halide photographic element, having a coated layer formed by providing on at least one surface of a support material a layer of a composition containing a compound curable with electron beam, a coupling agent and an inorganic white pigment, said layer having been cured with an electron beam; and having at least one layer of silver halide emulsion on said coated layer.

According to a preferred embodiment of the present invention, the above coupling agent has C=C unsaturated double bonds within the molecule. According to this embodiment of the invention, due to the presence of C=C unsaturated double bonds in the molecule, various objects as mentioned above can be realized with higher effect, and the phenomenon to form precipitates on the surface or in the inner portions during the manufacturing steps or storage process, namely bleed, can be reduced, and further damage resistance can be improved.

DESCRIPTION OF THE PREFERRED EMBODIMENTS

The compound curable with electron beam to be used in the present invention may preferably be a resin containing two or more unsaturated double bonds in the molecular chain which can cure by polymerization or crosslinking with generation of radicals by electron beam irradiation.

Accordingly, it is possible to use any resin curable with electron beam known for use in photographic supports or in various technical fields, having acrylic double bonds such as acrylic acid, methacrylic acid or esters of these, allylic double bonds such as diallyl phthalate, unsaturated bondings such as maleic acid, maleic acid derivatives, etc.

However, particularly when a paper material is used as the support material, embrittlement of the coated layer is liable to be caused by increase of the amount of the inorganic white pigment added. In view of this point, the materials which do not impair flexibility of paper may include those as enumerated below.

(1) Urethaneacrylate type oligomer

Effective are polyurethane elastomers, prepolymers and telomers prepared by condensation polymerization of various polyvalent isocyanates such as 2,4-toluenediisocyanate, 2,6-toluenediisocyanate, 1,3-xylenediisocyanate, 1,4-xylenediisocyanate, 1,5-naphthalenediisocyanate, m-phenylenediisocynate, p-phenylenediisocyanate, 3,3'-dimethyl-4,4'-diphenylmethanediisocyanate, 4,4'-diphenylmethanediiocyanate, 3,3'-dimethylbiphenylenediisocyanate, 4,4'-biphenylenediiosocyanate, hexamethylenediisocyanate, isophoronediisocyanate, dicyclohexylmethanediisocyanate, Desmodur L, Desmodur N, etc. with;

(i) linear saturated polyesters such as those prepared by condensation polymerization of polyhydric alcohols such as ethylene glycol, diethylene glycol, glycerine, trimethylol propane, 1,4-butane diol, 1,6-hexane diol, pentaerythritol, sorbitol, neopentyl glycol, 1,4-cyclohexanedimethanol, etc. with saturated polybasic acids such as phthalic acid, isophthalic acid, terephthalic acid, maleic acid, succinic acid, adipic acid, sebacic acid, etc;

(ii) linear saturated polyethers such as polyethylene glycol, polypropylene glycol, polytetraethylene glycol, etc.; or (iii) caprolactam, hydroxy-containing acrylates, hydroxy-containing methacrylates, etc.

It is also possible to use urethane acryrate series olygomers prepared by modifying the isocyanate group or hydroxy group at the terminal end of the above urethane elastomers, prepolymers or telomers by the reaction with a monomer having an acrylilc double bond or an allylic double bond reactive therewith.

These oligomers are preferred to have a molecular weight of about 500 to 20,000.

(2) Spirane ring-containing acrylic oligomer

This is a compound which is liquid at room temperature, having a spirane ring within the molecule, having also acrylic double bonds at both terminal ends of the molecule. This compound is preferred to have a molecular weight of about 500 to 20,000, more preferably about 500 to 2000.

Typical examples are those prepared by acetalation by the reaction between one mole of tetramethylolmethane and 2 moles of the compound having aldehyde group, subsequently reacting a polyvalent alcohol with the vinyl groups at both terminal ends of the acetal to synthesize a spirane ring-containing oligomer of the formula:

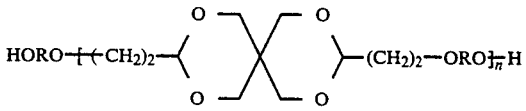

wherein R is an alkylene group and n is an integer, and then carrying out esterification reaction of the hydroxy groups at both terminal ends with an acrylic unsaturated acid such as acrylic acid, methacrylic acid, etc.

Commercially available products of such spirane ring-containing acrylic oligomers include Spirak T-500, T-510X-7N, T-502X-4, U-3000, U-3150, U-3151 and E-4000. produced by Showa Highpolymer Co., Ltd.

(3) Butadiene type oligomer

Compounds having acrylic unsaturated double bonds added to the oligomers having —OH groups at both terminal ends such as 1,2-polybutadiene glycol NISSO-pB, G-1000, 2000, 3000, TEA-1000, TEA-2000, produced by Nippon Soda Co., Ltd., or PolyBD Liquid Resin R-15, produced by Sinclair Petrochemical Co., or cyclized polybutadiene such as CBR-M901, produced by Japan Synthetic Rubber Co., Ltd. These oligomers should preferably have a molecular weight of 500 to 20,000.

Specific examples of these compounds curable with electron beam are set forth below, which, however, should not be construed to be as limitative of the invention.

$$CH_2{=}CH{-}COO{-}CH_2CH_2O{-}COO{-}NH{-}\phi{-}NH{-}COO\left[CH_2CH_2O{-}CO{-}NH{-}\phi{-}NH{-}COO\right]_n CH_2CH_2{-}COO{-}CH{=}CH_2 \quad (1)$$

(n is 1 to 10 and $\phi$ is 1,2-phenylene or 1,3-phenylene; being the same hereinafter)

-continued $$CH_2{=}CH{-}COO{-}CH_2CH_2O{-}COO{-}NH{-}\phi_1{-}NH{-}COO\left[(CH_2)_6OCO{-}(CH_2)_4COO\right]_n(CH_2)_6 \quad (2)$$

$$CH_2{=}CH{-}COOCH_2CH_2{-}COO{-}HN{-}\phi_1{-}NH{-}COO$$

(n is 1 to 10 and $\phi_1$ is 4-methyl-1,3-phenylene; being the same hereinafter)

$$CH_2{=}CH{-}COO{-}CH_2CH_2\left[NHCO{-}O{-}(CH_2)_4{-}O{-}CONH{-}CH_2{-}CH_2\right]_nOOC{-}CH{-}CH{=}CH_2 \quad (3)$$

(n is 1 to 20)

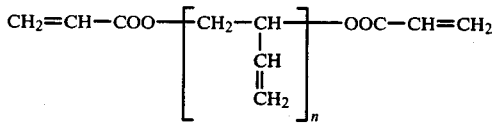

(n is 1 to 50)

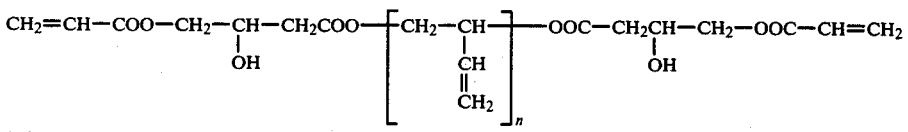

(n is 1 to 20)

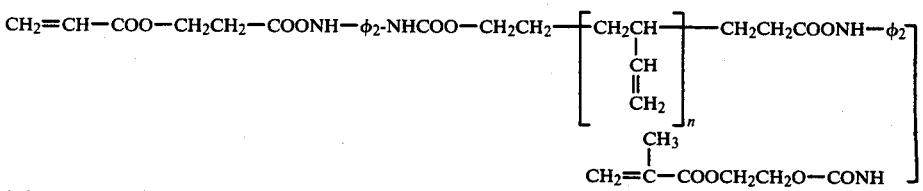

(n is 1 to 20 and $\phi_2$ is 2-methyl-1,3-phenylene; being the same hereinafter)

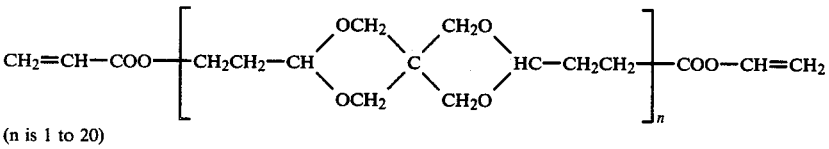

(n is 1 to 20)

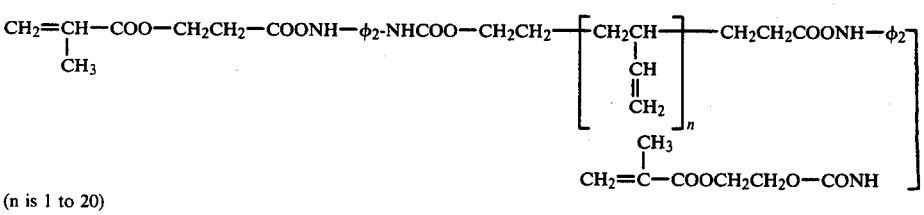

(n is 1 to 20)

These compounds curable with electron beam may also be used as a mixture of two or more compounds.

Further, for the purpose of controlling curability or flexibility, it is also preferable to add an electron beam curable compound for accelerating the curing speed of these compounds with electron beam, for example, one or two or more kinds of the oligomers as shown below, preferably in an amount of 20 to 60% by weight.

Preferable compounds include the following:

$$(CH_2{=}CHCOOCH_2)_3C{-}C_2H_5 \quad (1)$$

$$(CH_2{=}CHCOOCH_2)_3C{-}CH_2OH \quad (2)$$

$$[CH_2{=}CHCO{-}(OC_3H_6){-}OCH_2]_3{-}CCH_2CH_3 \quad (3)$$

$$CH_2{=}CHCOO(CH_2)_4OCOCH{=}CH_2 \quad (4)$$

$$CH_2{=}CHCOO(CH_2)_6OCOCH{=}CH_2 \quad (5)$$

$$CH_2{=}\overset{CH_3}{\overset{|}{C}}{-}CO{-}(O{-}CH_2{-}CH_2)_n{-}O{-}CO{-}\overset{CH_3}{\overset{|}{C}}{=}CH_2 \quad (6)$$

(n is 1 to 14)

$$CH_2{=}CH{-}CO{-}O{-}(CH_2{-}OH_2O)_n{-}CO{-}CH{=}CH_2 \quad (7)$$

(n is 4 to 14)

Further, for the purpose of improving flexibility and adhesiveness of the base material for the support, a thermoplastic resin, as typically shown by the following examples, may be used as a mixture.

(1) Cellulose derivatives

Nitrocellulose, cellulose acetate butyrate, ethyl cellulose, butyl cellulose, etc.

(2) Polyvinyl alcohol type resin

Polyvinyl alcohol, polyvinyl butyral, polyvinyl acetal, etc.

(3) Polybutadiene and butadiene copolymers

Polybutadiene, acrylonitrile-butadiene copolymer, styrene-butadiene copolymer, etc.

(4) Vinyl chloride type copolymers

Vinyl chloride-vinyl acetate copolymer, vinyl chloride-vinyl acetate-maleic acid copolymer, etc.

(5) Polyurethane resins (6) Unsaturated, saturated polyester resins (7) Polyamide resins, and others.

These thermoplastic resins may either have acrylic modified double bonds incorporated therein or not.

These thermoplastic resins should be incorporated at a mixing ratio of 80/20 to 40/60 wt. % relative to the total amount of the compound curable with electron beam and the electron beam curable compound for improvement of curing speed.

Referring next to the coupling agent in the present invention, it has two or more different reactive groups in its molecule, one of these reactive groups being capable of chemical bonding with an inorganic white pigment (e.g. methoxy group, ethoxy group or silanol group), and the other being capable of chemical bonding with a compound curable with electron beam (e.g. epoxy group, methacrylic group, amino group, or C=C unsaturated double bond according to a preferred embodiment).

Such a coupling agent has the function of playing a role for crosslinking through strong chemical bonding between the compound curable with electron beam and the inorganic white pigment.

As a consequence, the following excellent effects can be obtained.

(1) Since dispersibility and filling characteristic of the inorganic white pigment can be improved sufficiently, the surface smoothness of the coated layer becomes good.

(2) Even when the content of the inorganic white pigment may be increased to a higher concentration, storage stability of the resultant composition can be maintained for a long time, whereby workability during coating can be markedly enhanced.

(3) The inorganic white pigment can be reinforced effectively at their interfaces, with the advantage that the resin curable with electron beam employed can be chosen from a wide variety of resins.

In this case, the coupling agent may preferably be a silane coupling agent or a titanium coupling agent, and it is added so as to cover over the surface of the inorganic white pigment.

That is, the coupling agent reacts chemically with the hydroxy group of the inorganic white pigment and the hydroxy group in the metal oxide layer covering partially over its surface.

More specifically, in the case of a silane coupling agent, having a group for forming silanol group and/or a silanol group, it reacts in the form of silanol group with the hydroxy group of the inorganic white pigment or the hydroxy group existing on the metal oxide surface covering partially over the surface, thereby forming chemical bonding with the inorganic white pigment.

On the other hand, in the case of a titanium coupling agent, it will react potently with the hydroxy group of the inoganic white pigment or the hydroxy group existing on the metal oxide surface covering partially over its surface, whereby the bonding between titanium atom and

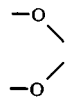

or —OR is cleaved to form a chemical bonding of ether bonding or ester bonding.

According to a preferred embodiment of the present invention, the silane or titanate coupling agent contains C=C double bonds and therefore, when curing, can also effect firm chemical bonding with a compound curable with electron beam.

More specifically, such a coupling agent or the present invention having unsaturated double bonds curable with electron beam irradiation together with alkoxy group, etc. exhibiting the coupling action, undergoes radical polymerization reaction through the double bonds with the radicals generated from the compound curable with electron beam, thereby forming a crosslinked structure which is cured.

Thus, the above compound can be firmly bonded with the inorganic white pigment, on one hand, while with the compound curable with electron beam, on the other.

Typical examples of the coupling agents to be used in the present invention are enumerated below:

Silane coupling agents:

$CH_3Si(OCH_3)_3$ (A-1)

$CH_3Si(OC_2H_5)_3$ (A-2)

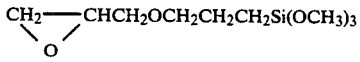

(A-3)

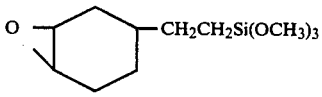

(A-4)

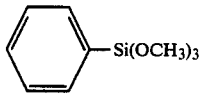

(A-5)

$NH_2CH_2CH_2NH(CH_2)_3Si(CH_3O)_3$ (A-6)

$CH_3(CH_2)_7Si(OCH_3)_3$ (A-7)

$NH_2(CH_2)_3Si(OC_2H_5)_3$ (A-8)

$CF_3(CF_2)_3CH_2CH_2Si(CH_3O)_3$ (A-9)

Titanium coupling agents:

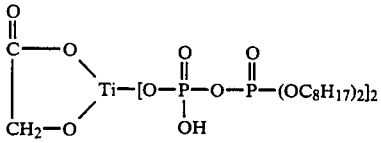

(A-10)

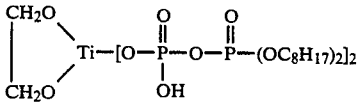

(A-11)

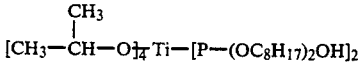

(A-12)

$(C_8H_{17}O)_4Ti—[P—(OC_{13}H_{27})_2OH]_2$ (A-13)

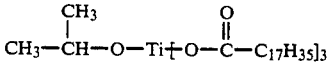

(A-14)

-continued

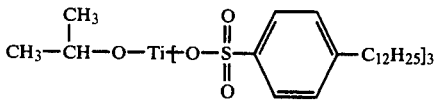

(A-15)

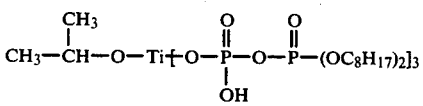

(A-16)

Silane coupling agents having unsaturated bonds in the molecule:

(B-1) $CH_2=CHSi(OC_2H_5)_3$
(B-2) $CH_2CHSi(OC_2H_4OCH_3)_3$
(B-3) $CH_2CCH_3CO_2CH_2CH_2Si(OCH_3)_3$
(B-4) $CH_2=CHCO_2CH_2CH_2Si(OCH_3)_3$
(B-5) $CH_2=CCH_3CO_2CH_2CH_2Si(OCH_2CH_3)_3$
(B-6) $CH_2=CHCO_2CH_2CH_2Si(OCH_2CH_3)_3$
(B-7) $CH_2=CCH_3CO_2CH_2CH_2CH_2Si(OCH_3)_3$
(B-8) $CH_2=CHCO_2CH_2CH_2CH_2Si(OCH_3)_3$
(B-9) $CH_2=CCH_3CO_2CH_2CH_2CH_2CH_2Si(OCH_2CH_3)_3$
(B-10) $CH_2=CCH_3CO_2CH_2CH_2CH_2CH_2Si(OCH_3)_3$
(B-11) $CH_2=CHCO_2CH_2CH_2CH_2CH_2Si(OCH_3)_3$
(B-12) $CH_2=CHCO_2CH_2CH_2CH_2CH_2Si(OCH_2CH_3)_3$
(B-13) $CH_2=CHCH_2NHCH_2CH_2CH_3Si(OCH_3)_3$
(B-14)
$CH_2=CHCH_2NHCH_2CH_2NHCH_2CH_2CH_2Si(OCH_3)_3$

Titanium coupling agents having double bonds in the molecule:

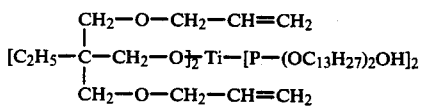

(B-15)

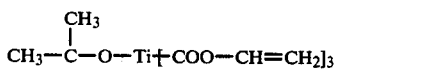

(B-16)

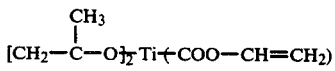

(B-17)

Most of these coupling agents are commercially available. Examples thereof are TTS, 9S, 38S, 46B, 55, 138S and 238S, produced by Kelnich Petrochemical Co., Ltd.; KBE-1003, KBL-1003, KBM-403, KBM-508 and KBM-603, produced by Shin-Etsu Chemical Co., Ltd.; and SH-6031, SH-6032, SH-6040, SH-6070 and SH-6075, produced by Toray-Silicone Co., Ltd.

Such coupling agents may be incorporated into the coating layer according to the methods as described below.

According to a first method, an inorganic white pigment and the above coupling agent dissolved in a solvent are added at the same time into one or a mixture of two or more compounds curable with electron beam as described above, followed by mixing and dispersing, and then the resultant dispersion is applied and allowed to cure on a support material.

According to a second method, the coupling agent is dissolved in a suitable solvent and an inorganic white pigment is dipped in this solution to pre-treat the surface, followed by drying, and the treated coupling agent is mixed and dispersed in one or a mixture of two or more of compounds curable with electron beam to prepare a composition, which is then applied and allowed to cure on a support material.

According to a third method, one or a mixture of two or more of compounds curable with electron beam as described above is dissolved in a suitable organic solvent, and the inorganic white pigment subjected previously to the surface treatment with a coupling agent and dried is mixed and dispersed in the solution, and then the dispersion is applied and allowed to cure on a support material.

Further, according to a fourth method, before addition of a compound curable with electron beam, the coupling agent is dispersed in an organic solvent together with an inorganic white pigment, followed by addition of a compound curable with electron beam to prepare a mixed and dispersed composition, which is in turn applied and allowed to cure on a support material.

Among these methods, it is preferred to employ the method in which the inorganic white pigment previously treated with a coupling agent and dried is used.

In these methods, when employing an organic solvent, the viscosity of the composition is lowered, and the filling characteristic of the inorganic filler can be improved, whereby the surface smoothness of the coated layer can be further improved.

The amount of these coupling agents may preferably be 0.1 to 20 wt. % based on the inorganic white pigment.

In this case, the coupling agent should more preferably be employed in an amount within the range of from 0.5 to 10 wt.%.

The inorganic white pigment to be used in the present invention may be any of titanium oxide (anatase type, rutile type), barium sulfate, calcium carbonate, aluminum oxide, magnesium oxide, etc., paticualrly preferably titanium oxide, barium sulfate and calcium carbonate.

The titanium oxide may also be coated partially on its surface with a hydrous metal oxide such as hydrous aluminum oxide, hydrous ferrite oxide, etc.

The inorganic white pigment should be employed preferably in an amount within the range of from 20 to 200 parts by weight based on 100 parts by weight of the compound curable with electron beam.

In this case, the amount should more preferably be 30 to 150 parts by weight.

The pigment should preferably have an average particle size of 0.1 to 10 $\mu$m.

Thus, the composition for coating of a coated layer in the present invention comprises a compound curable with electron beam, a coupling agent and an inorganic white pigment, but it is also possible to add a solvent in the composition.

In this case, particularly when employing an organic solvent, the viscosity of the coating composition can be lowered to improve further the filling characteristic of the inorganic white pigment, thereby further improving the surface smoothness. On the other hand, when employing no organic solvent, it is another advantage that there is no necessity of providing a step to remove the solvent.

The solvent to be employed is not particularly limited, but it can adequately be chosed in view of the compound curable with electron beam employed, as well as solubility and compatibility of the coupling agent.

The solvent preferably used in preparation of the composition may include:

alcohols such as methanol, ethanol, isopropanol, butanol, etc.;

ketones such as acetone, methyl ethyl ketone, methyl isobutyl ketone, cyclohexanone, etc.;

esters such as methyl acetate, ethyl acetate, butyl acetate, ethyl butyrate, etc.;

ethers such as ethyleneglycol dimethyl ether, ethyleneglycol monoethyl ether, dioxane, etc.;

aromatic hydrocarbons such as benzene, toluene, xylene, etc.;

aliphatic hydrocarbons such as hexane, butane, etc.; or mixtures of these.

The support materials to be used in the present invention may be commercially available papers of general grade or pure grade, or otherwise paper materials comprising natural pulp, synthetic pulp or a mixture threof.

Alternatively, it is also possible to employ a film comprising polyester base or a polyolefin base, containing an inorganic white pigment dispersed therein, if desired.

The paper material may have a basis weight preferably of 60 to 250 g/m$^2$ more preferably of 80 to 190 g/m$^2$, and its surface may be either smooth or rough.

The composition for coating in the present invention may be prepared as follows.

That is, the respective components as described above are charged into a kneading machine all at once or successively.

For kneading and dispersing of the coating composition, various kneading machines may be available. For example, there may be employed two-roll mill, three-roll mill, pebble mill, ball mill, sand grinder, high-speed stone mill, sand grinder, high-speed shock mill, kneader, homogenizer, etc.

Also, as the coating method, it is possible to use air doctor coating, blade coating, squeeze coating, air knife coating, reverse roll coating, cast coating, etc.

Thickness of the coating may preferably be 1 to 100 μm, more preferably 5 to 50 μm.

Such a composition for coating can be applied on the support material on the side on which the silver halide emulsion is to be applied and then allowed to cure with irradiation of electron beam to form a coated layer.

In this case, on the opposite side of the support material, it is preferred to provide a back coat layer which is formed by applying a composition comprising a compound curable with electron beam as described above and, if desired, a compound for improvement of curing speed as described above and a thermoplastic resin, further preferably a solvent as described above, and allowing the coating to cure by electron beam irradiation.

The back coat layer may also incorporate an inorganic white pigment, and in this case a coupling agent should preferably be contained therein.

For application of the composition for coating, by means of a two-stage coater head, the emulsion coated surface and its opposite surface are coated with the composition at the same time, followed immediately by drying under heating to remove a part or all of the solvent, and then electron beam irradiation is effected until the coated layer was cured, followed by wind-up on a roll.

Alternatively, immediately after coating, electron beam irradiation may be effected to allow the coated layer to cure, followed by drying under heating to remove the solvent in the coated layer, followed by wind-up on a roll.

When a two-stage coater head is not available, the emulsion coated surface is first coated with the composition, and after drying and curing according to the same procedure as described above, once wound up on a roll, and subsequently the opposite surface is coated with the composition, followed by drying, curing and wind-up on a roll according to the same procedure as described above.

When carrying out coating and wind-up according to the respective procedures as described above, the composition after preparation is stable without suffering from changes caused by changes in temprature, humidity, the concentrations of the materials employed. Besides, no generation of agglomeration or gel occurs during coating, and coating operations can be done stably over a long time.

Also, when the coated layer first coated and allowed to cure on the support is superposed onto the support material or the layer coated and allowed to cure on the opposite surface, no blocking due to bleed-out of the coupling agent occurs, and therefore the coating operation efficiency and the surface state of the coated layer will not be lowered.

And, the composition according to the present invention is also free from generation of agglomeration or gel even when containing a large amount of an inorganic white pigment or even when coated after storage for a long time to afford good coating operation, and also no blocking occurs during wind-up on a roll.

The coated layer of the present invention can be subjected to mirror finishing by application of a smoothening treatment, or also applied with embosses, if desired.

For carrying out mirror finishing, the surface to be treated is brought into contact with a mirror surfaced roll and electron beam is irradiated on the back of said surface until the surface has cured, thereby applying a mirror finishing. Alternatively, after a part of the surface has cured by effecting previously preliminary irradiation, it is brought into contact with a mirror surfaced roll and peeled off to be subjected to secondary irradiation, thereby effecting completely curing.

The mirror surfaced roll may include chromium plated rolls and stainless steel rolls.

When applying embosses, the emboss rolls to be employed in place of the mirror surfaced roll may include those having desired embosses such as silk pattern, fine grain pattern, etc. formed on rolls such as stainless steel rolls, chromium plated rolls, etc. according to surface abrasion, vapor deposition, etching, plating, etc.

Application of mirror finishing or embossing treatment can be conducted, after coating of the composition, after a part or all of the organic solvent has been removed. Alternatively, after application of embossing, the organic solvent may be removed.

The coated layer may be dried at a temperature which is about 50° to 120° C., preferably 70° to 100° C., particularly preferably 80° to 90° C.

The drying time may be about 10 seconds to 10 minutes, preferably about 20 seconds to 5 minutes.

The electron beam accelerator to be employed may be any of electrocurtain system, Van de Graff type scanning, double scanning system, etc.

As for the electron beam characteristics, it is preferred from aspect of transmitting power to employ an electron beam accelerator of 100 to 750 KV, preferably 150 to 300 KV and control the absorption dosage to 0.5 to 20 Mrad.

Irradiation of electron beam should desirably be conducted in an inert gas atmosphere of, for example, $N_2$, He, $CO_2$, etc.

In the composition for coating of the present invention, it is also possible to add lubricants, abrasives, antistatic agents, if necessary.

Also, for the purpose of improving adhesiveness with the light-sensitive silver halide emulsion layer, the surface treatment such as corona treatment may be applied, or separately a subbing layer may be applied on the surface of the coated layer.

The silver halide emulsion layer and the layer constitution of the light-sensitive silver halide photographic element to be provided on such a coated layer may be any one of those known in the art.

According to the present invention, dispersibility of an inorganic white pigment can be improved to great extent, whereby sharpness of the photographic image can become extremely good.

Also, the filling characteristic of an inorganic pigment can be improved to great extent, whereby the smoothness of the support surface can be improved and coating irregularity of the emulsion can be extremely reduced.

Further, the cured coated layer is excellent in flexibility and substantially free from generation of stress cracks or stress crazes.

Also, the adhesiveness of the coated layer is very high.

And, the charging characteristics of the coated layer are practically sufficiently small.

The present inventors have carried out various experiments in order to confirm the effect of the present invention.

The following examples are set forth for illustration of the present invention.

EXPERIMENTAL EXAMPLE 1

(1) Preparation of Sample No. 1

| | |
|---|---|
| Terminal acryl-modified polybutadiene (average molecular weight: 1000, produced by Nippon Soda Co., TEA-1000) | 70 wt. parts |
| $CH_2{=}CH{-}COO{-}(CH_2)_6{-}OOC{-}CH{=}CH_2$ | 20 wt. parts |
| Trimethylolpropane triacrylate | 10 wt. parts |
| Titanium oxide (rutile type, average particle size 0.2 μm) | 50 wt. parts |
| Tetraisopropyl-bis-dioctylphosphite titanate (Prenact 41B, produced by Kenlich Petrochemical Co., titanium coupling agent) | 5 wt. parts |
| Methyl ethyl ketone/toluene (1:1 mixture) | 30 wt. parts |

After the above composition was mixed and dispersed in a ball mill for 48 hours, one surface of a pure paper with a basis weight of 150 g/m² was coated with the resultant mixture by a curtain coater to a thickness of 30 μm.

Then, after removal of the solvent of the coating by drying (at 100° C. for one minute), electron beam was irradiated on the coating by means of an electron beam accelerating device under a nitrogen atmosphere at 150 KV at a dosage of 5 Mrad.

The cured coating layer was once wound up, and on the side opposite to the coating layer was further applied the same composition as above except for containing no titanium oxide to a thickness of 30 μm, and after drying and curing according to the same procedure, the coated paper was wound up.

This sample is designated as Sample No. 1.

(2) Preparation of Sample No. 2

After 100 g of titanium oxide (anatase type, average particle size 0.2 μm) was washed with acetone and dried, it was placed in 500 ml of methanol containing 3 g of β-glycidoxypropylmethoxysilane (KBM 403, produced by Shin-Etsu Chemical Co., Ltd.) dissolved therein. The mixture was mixed with stirring for 2 hours and thereafter left to stand for about 6 hours. The solvent was evaporated under reduced pressure, and the titanium oxide was dried on air, followed by heat treatment at 130° C. for 10 minutes.

| | |
|---|---|
| The above surface-treated titanium oxide | 60 wt. parts |
| Urethane acrylate oligomer represented by $CH_2{=}CH{-}COO{-}CH_2CH_2{-}[{-}NHCO{-}(CH_2)_4{-}CONH{-}CH_2{-}CH_2{-}]_n{-}OOC{-}CH{=}CH_2$ [Exemplary compound (3), n = 8] | 80 wt. parts |
| Trimethylolpropane triacrylate | 20 wt. parts |
| Methyl ethyl ketone/cyclohexanone (1:1 mixture) | 50 wt. parts |

Subsequently, a composition comprising the above components was mixed and dispersed in a ball mill for 36 hours, and the resultant dispersion was applied by coating by means of a curtain coater on both surfaces of a pure paper having a basis weight of 180 g/m² each to a thickness of 30 μm.

Then, after removal of the solvent of the coating by drying (at 100° C. for one minute), electron beam was irradiated on the coating by means of two sets of electron beam accelerating devices under a nitrogen atmosphere at 150 KV at a dosage of 7 Mrad until the coating had cured, followed by wind-up.

This sample is designated as Sample No. 2.

(3) Preparation of Sample No. 3

The calcium carbonate employed (average particle size 0.3 μm) was subjected to the same surface treatment as in preparation of Sample No. 2 except for using 2% methyl ethyl ketone solution of tetraisopropyl-bis-dioctylphosphite titanate (Prenact 41B, produced by Kenlich Petrochemical Co.).

| | |
|---|---|
| Calcium carbonate | 100 wt. parts |
| Spirane ring containing acryl oligomer (Spirac U-3000, produced by Showa Highpolymer Co., Ltd.) | 60 wt. parts |
| Polyurethane resin (Estane 5702, produced by B. F. Goodrich Co.) | 20 wt. parts |
| $CH_2{=}CH{-}COO{-}(CH_2)_6{-}OOC{-}CH{=}CH_2$ | 20 wt. parts |
| Methyl ethyl ketone/toluene | 30 wt. parts |

The above composition was mixed and dispersed in a ball mill for 72 hours, and then applied by coating on one surface of a pure paper with a basis weight of 150 g/m² by means of a curtain coater to a thickness of 20 μm.

Then, after removal of the solvent in the coating layer (at 100° C. for one minute), while bringing the layer into contact with a mirror surface roll, the layer was irradiated from the opposite side with electron beam under a nitrogen atmosphere by means of an electron beam accelerating device at 150 KV at a dosage of 5 Mrad, to effect curing and mirror finishing simultaneously, followed by wind-up.

Subsequently, the same composition as above except for eliminating calcium carbonate was coated to a thickness of 30 μm. Then, following the same procedures as described above, drying, curing and mirror finishing were conducted, followed by wind-up. This sample is designated as Sample No. 3.

(4) Preparation of Sample No. 4 for Control

A sample was prepared according to the same procedure as in preparation of No. 3, except for employing calcium carbonate without application of surface treatment at all in place of the calcium carbonate applied with the surface treatment employed in Sample No. 3.

This sample is designated as Sample No. 4.

(5) Preparation of Sample No. 5 for Control

According to the same procedure as in preparation of Sample No. 1, except for using the same amount of tetrastearyltitanate [$Ti(OC_{18}H_{37})_4$] in place of the titanium coupling agent, Sample No. 5 was prepared.

(6) Preparation of Sample No. 6

A sample was prepared in the same manner as in preparation of Sample No. 1 except for using the coupling agent (B-8) exemplified as the silane coupling agent having unsaturated bonds in the molecule, in place of tetraisopropyl-bis-octylphosphite titanate.

This is designated as Sample No. 6.

(7) Preparation of Sample No. 7

A sample was prepared in the same manner as in preparation of Sample No. 2 except for using the coupling agent (B-2) exemplified as the silane coupling agent having unsaturated bonds in the molecule, in place of γ-glycidoxypropyltrimethoxysilane.

This sample is designated as Sample No. 7.

(8) Preparation of Sample No. 8

A sample was prepared in the same manner as in the preparation of Sampe No. 3 except for using 5% methanol solution of the coupling agent (B-15) exemplified as the titanate coupling agent having double bond in the molecule, in place of 2% methyl ethyl ketone solution of tetraisopropyl-bis-dioctylphosphite titanate.

This sample is designated as Sample No. 8.

(9) Preparation of Sample No. 9 for Control

A sample was prepared according to the same procedure as in preparation of No. 8, except for employing calcium carbonate without application of surface treatment at all in place of the calcium carbonate applied with the surface treatment employed in Sample No. 8.

This sample is designated as Sample No. 9.

Using the respective Samples No. 1 to No. 9, evaluation tests were conducted about the following items:

[EVALUATION ITEMS]

(1) Storage stability of inorganic white pigment after preparation of the composition:

After preparation of the composition, the composition of each sample was weighed and the state of sedimentation after 48 hours of the inorganic white pigment was evaluated according to the three standards as shown below:

A: No sedimentation at all

B: Sedimentation occurs partly

C: Large amount of sedimentation, separated from the resin (2) Surface finishing of coated layer:

The sample wound up was sampled and its surface state was evaluated according to the three standars as shown below:

A: Very good smoothness

B: Good smoothness

C: Agglomeration generated on the whole surface (3) Adhesiveness of the coated layer:

A cellophane tape (NICHIBAN, produced by Nichiban Co., Ltd.) of 2 mm×25 mm square was plastered on the coated layer and the state of the coating when the cellophane tape was peeled off momentarily was evaluated according to the three standards shown below:

A: No abnormality at all

B: Partially peeled off

C: Completely peeled off (4) Flexural characteristic (bending test)

With the use of a bending tester, while setting the coated layer surface on the emulsion layer side to face to the outside, the film state at a radius of curvature of bending of 2 mm and a bending angle of 180° was evaluated according to the three standards as shown below (after bending repeated for 5 times):

A: No abnormality at all

B: Cracks generated partially

C: Cracks generated wholly (5) Sharpness

Measurement of sharpness (resolution) was performed by applying a photographic emulsion for color on each sample obtained, then printing a color chart for measurement of resolution thereon and observing the color chart with naked eyes. Evaluation was made as follows:

A: Very good

B: Good

C: Poor (6) Bleed after left to stand under high humidity:

(i) A sample was left to stand under the conditions of 23° C. and 90% RH for one month, and the surface was observed with naked eyes under white light.

(ii) A sample was left to stand under the conditions of 40° C. and 80% RH for 14 days, and the surface was observed with naked eyes under white light.

Both (i) and (ii) were evaluated as follows:

A: No bleed at all

B: Bleed appears only partially

C: Bleed appears noticeably (7) Anti-scratch property

A sapphire stylus having the radius of curvature of 0.15 mm to which a static load was applied was allowed to slide over the sample at a constant speed (6.0 cm/sec) to measure the load at which the sample surface begins to be scratched with the stylus.

Results of the above (1) to (7) are shown in Table 1.

From the results shown in Table 1, the effect of the present invention can clearly be seen.

TABLE 1

| Sample No. | Evaluation items | | | | | | | |
|---|---|---|---|---|---|---|---|---|
| | (1) | (2) | (3) | (4) | (5) | (6-i) | (6-ii) | (7) |
| 1 | A | A | A | A | A | A | A | 90 g |
| 2 | A | A | A | A | A | A | A | 80 g |
| 3 | A | A | A | A | A | A | A | 90 g |
| 4 | C | C | C | C | B | A | A | 50 g |
| 5 | C | C | C | C | B | C | C | 60 g |
| 6 | A | A | A | A | A | A | A | 150 g |
| 7 | A | A | A | A | A | A | A | 140 g |
| 8 | A | A | A | A | A | A | A | 150 g |
| 9 | C | C | C | C | B | B | B | 40 g |

We claim:

1. A light-sensitive silver halide photographic element having (a) a cured coated layer on at least one surface of a support material, said cured coated layer having been formed by curing a composition with electron beam radiation, said composition prior to curing comprising (i) a compound having two or more unsaturated double bonds in its molecule which is curable by electron beam irradiation, (ii) an inorganic white pigment and (iii) a silane or a titanium coupling agent having two or more different reactive groups in its molecule, one of said reactive groups being chemically reactive with the inorganic white pigment to form a chemical bond therewith and said other reactive group being chemically reactive with said compound (i) to form a chemical bond therewith and (b) at least one layer of silver halide emulsion on said coated layer.

2. The light-sensitive silver halide photographic element according to claim 1, wherein said support material is a paper material and said compound (i) is a resin selected from the group consisting of urethaneacrylate oligomers, spirane ring-containing acrylic oligomers and butadien type oligomers.

3. The light-sensitive silver halide photographic element according to claim 1, wherein said coupling agent (iii) is a silane coupling agent.

4. The light-sensitive silver halide photographic element according to claim 1, wherein said coupling agent (iii) has unsaturated C=C double bond in the molecule.

5. The light-sensitive silver halide photographic element according to claim 4, wherein said coupling agent iii is a titanate coupling agent.

6. The light-sensitive silver halide photographic element according to claim 1, wherein the surface of said inorganic white pigment (ii) is covered with said coupling agent (iii).

7. The light-sensitive silver halide photographic element according to claim 1, wherein said coupling agent (iii) is in an amount of from 0.1 to 20 wt.% based on the inorganic white pigment (ii).

8. The light-sensitive silver halide photographic element according to claim 1, wherein said inorganic white pigment (ii) is selected from the group consisting of titanium oxide, barium sulfate, calcium carbonate, aluminum oxide and magnesium oxide.

9. The light-sensitive silver halide photographic element according to claim 1, wherein said inorganic white pigment (ii) is used in an amount of from 20 to 200 parts by weight based on 100 parts by weight of the compound curable with electron beam.

10. The light-sensitive silver halide photographic element according to claim 1, wherein said inorganic white pigment (ii) has an average particle size of from 0.1 to 10 μm.

11. The light sensitive silver halide photographic element according to claim 1, wherein said cured coated layer of a composition comprising a compound (i), a coupling agent (iii) and an inorganic white pigment (ii) is on both surfaces of said support.

* * * * *